US005993285A

United States Patent [19]

Sofia et al.

[11] Patent Number: 5,993,285

[45] Date of Patent: Nov. 30, 1999

[54] TEETHING DEVICE

[75] Inventors: Susan Sofia, Boston; Deborah H. Levenson, Newton, both of Mass.

[73] Assignee: The First Years Inc., Avon, Mass.

[21] Appl. No.: 08/847,049

[22] Filed: May 1, 1997

[51] Int. Cl.[6] ..... A63H 3/14

[52] U.S. Cl. ..... 446/327; 446/26

[58] Field of Search ..... 446/26, 327, 328, 446/329; 2/16, 20, 160, 161.4

[56] References Cited

U.S. PATENT DOCUMENTS

| | | | |
|---|---|---|---|
| D. 155,752 | 10/1949 | Vivaudou . | |
| 216,455 | 6/1879 | Primbs . | |
| D. 217,654 | 5/1970 | Ryland | 446/329 |
| 259,683 | 6/1882 | Hagen . | |
| D. 301,083 | 5/1989 | Wagner . | |
| 375,958 | 1/1888 | Skeffington | 2/158 |
| 607,963 | 7/1898 | Sinclaire . | |
| 660,886 | 10/1900 | Bryan . | |
| 961,149 | 6/1910 | Maynard . | |
| 1,117,093 | 11/1914 | Ripley . | |
| 1,204,663 | 11/1916 | Hockenhull . | |
| 1,275,837 | 8/1918 | Biggs | 2/158 |
| 1,417,860 | 5/1922 | Reich | 446/327 |
| 1,537,811 | 5/1925 | Epling . | |
| 1,574,341 | 2/1926 | Feldstein | 446/419 |
| 2,084,183 | 6/1937 | Blendinger . | |
| 2,546,209 | 3/1951 | Baum . | |
| 2,688,961 | 9/1954 | Thomas . | |
| 2,756,448 | 7/1956 | Werbe | 446/327 |
| 2,798,482 | 7/1957 | Feeney . | |
| 2,827,055 | 3/1958 | Carden . | |
| 2,840,950 | 7/1958 | Cotler . | |
| 2,902,693 | 9/1959 | Wells, Jr. . | |
| 3,442,267 | 5/1969 | Krygier | 446/26 |
| 4,304,065 | 12/1981 | Baiera | 446/327 |
| 4,685,599 | 8/1987 | Israel et al. | 446/26 |
| 4,694,510 | 9/1987 | Kamrath | 2/49 R |
| 5,070,541 | 12/1991 | Goss | 2/16 |
| 5,197,974 | 3/1993 | Scarpelli et al. | 606/235 |
| 5,263,975 | 11/1993 | La Rocca | 606/234 |
| 5,313,667 | 5/1994 | Levine | 2/16 |
| 5,322,465 | 6/1994 | McGill | 446/327 |
| 5,385,573 | 1/1995 | Wright | 446/28 |
| 5,553,324 | 9/1996 | Emerson | 2/158 |
| 5,685,809 | 11/1997 | Murray | 2/161.1 |
| 5,768,709 | 6/1998 | Newkirk et al. | 2/160 |

FOREIGN PATENT DOCUMENTS

| | | | |
|---|---|---|---|
| 8904706 | 6/1989 | WIPO | 446/26 |

*Primary Examiner*—D. Neal Muir
*Assistant Examiner*—Jeffrey D. Carlson
*Attorney, Agent, or Firm*—Fish & Richardson P.C.

[57] ABSTRACT

A teething device is provided, including a web of sheet material constructed to be positioned around an infant's hand without substantially confining the infant's fingers, and a toy, mounted on the web of sheet material in a position so that it rests on the back of the infant's hand when the device is in use.

12 Claims, 3 Drawing Sheets

TEETHING DEVICE

BACKGROUND OF THE INVENTION

The present invention relates to teething devices, i.e., devices that are suitable for use by teething infants.

Infants who are teething are often given rattles, teething rings, or other similar items to distract the infant and/or give the infant something soft to chew on. The infant has a tendency to drop such items, or, if the item is designed to be worn over the infant's hand, to feel uncomfortably confined.

SUMMARY OF THE INVENTION

The present invention provides a teething device which is constructed to be worn on the infant's hand in a manner which is comfortable and does not uncomfortably confine the infant's fingers. The teething device is also easy for an adult to put on and take off of the infant, without being easily removed by the infant himself. Preferred teething devices include both a teething portion on which the infant can chew, and a toy to amuse the infant and encourage the infant to use the teething portion, e.g., a soft animal-head shaped toy.

In one aspect, the invention features a device that includes (a) a first portion that is dimensioned to cover the back of the infant's hand when the device is in use, (b) second and third portions, extending beyond the first portion on opposite sides thereof, so as to extend around a portion of the infant's wrist while allowing movement of the infant's first, second and third fingers, and (c) an aperture dimensioned to receive an infant's thumb, positioned in the vicinity of the intersection of the first portion and one of the second and third portions. The device also includes a toy mounted on the first portion.

Preferred embodiments of the invention include one or more of the following features. The second and third portions are constructed to overlap, and the device further includes a fastener to secure the second and third portions in their overlapped position. The first, second and third portions define, when the device is in use, an opening dimensioned to receive the infant's fingers and allow relatively unrestricted movement of the infant's fingers. The device includes a second aperture constructed to receive the infant's thumb, the two apertures being positioned between the first portion and the second and third portions, so that the device can be easily worn on either hand. The sheet material is a fabric. The device further includes a teething portion constructed to be chewed on by the infant. The teething portion is preferably elastomeric, and more preferably includes a plurality of elastomeric tabs that are mounted between the first portion and the second and third portions, to extend outwardly from the infant's hand when the device is in use. The toy includes a rattle. The toy is constructed in the shape of an animal, e.g., a cow, or an animal's head, and is formed of a soft, resilient material that is fabric-covered. The rattle is contained in the head of the animal-shaped toy. The fastener is a hook-and-loop type fastener.

In another aspect, the invention features a teething device that includes a web of sheet material constructed to be positioned around an infant's hand without substantially confining the infant's fingers, and a toy, mounted on the web of sheet material in a position so that it rests on the back of the infant's hand when the device is in use.

Preferred embodiments of the invention include one or more of the following features. The sheet material is a fabric. The web includes an aperture constructed to receive the infant's thumb. The device includes elastomeric tabs that are mounted adjacent the apertures to extend outwardly therefrom when the device is in use and that are constructed to be chewed on by the infant. The toy includes a rattle. The toy is constructed in the shape of an animal, e.g., a cow, or an animal's head, and is formed of a soft, resilient material that is fabric-covered. The rattle is contained in the head of the animal-shaped toy. Preferred devices are washable.

The first, second and third portions can be separate pieces of fabric that are joined, e.g., stitched, together, can be a single, integral sheet of material, or can be a combination of the two. Similarly, the "web of sheet material" can comprise a plurality of portions that are joined together, or can comprise a single, integral sheet of material.

Other features and advantages of the invention will be apparent from the description of preferred embodiments thereof, taken together with the drawings, and from the claims.

DESCRIPTION OF THE PREFERRED EMBODIMENTS

Figure 1:
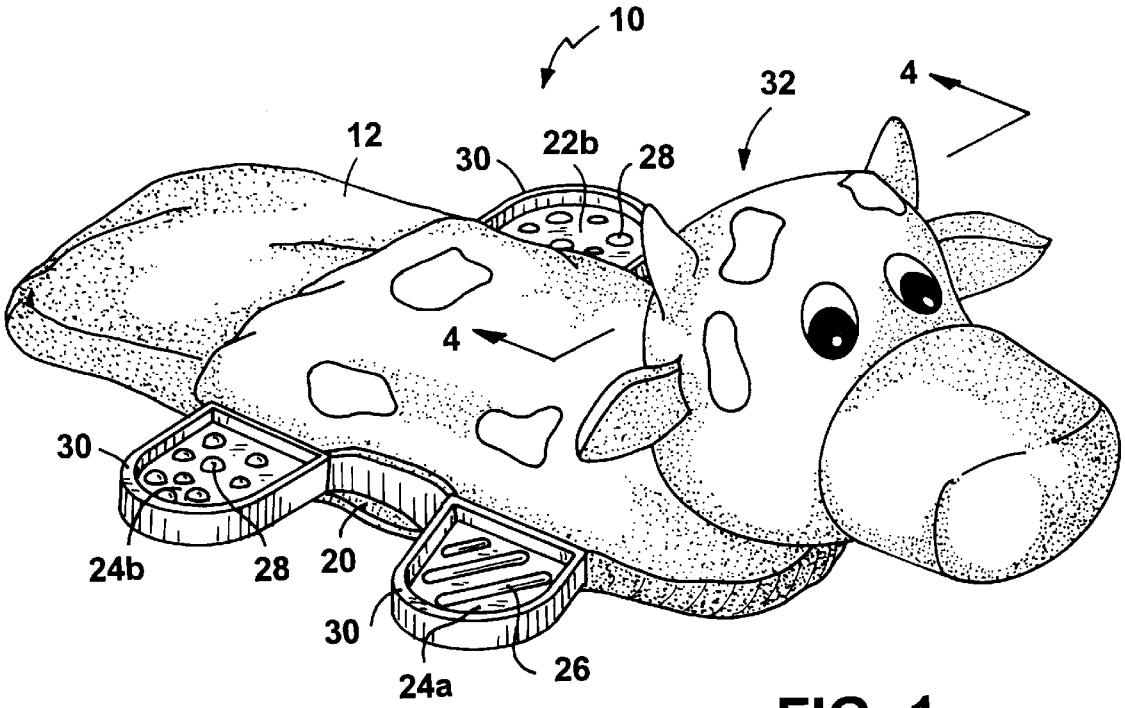
FIG. 1 is a perspective view of a teething device according to one aspect of the invention, taken from the front.
Figure 4:
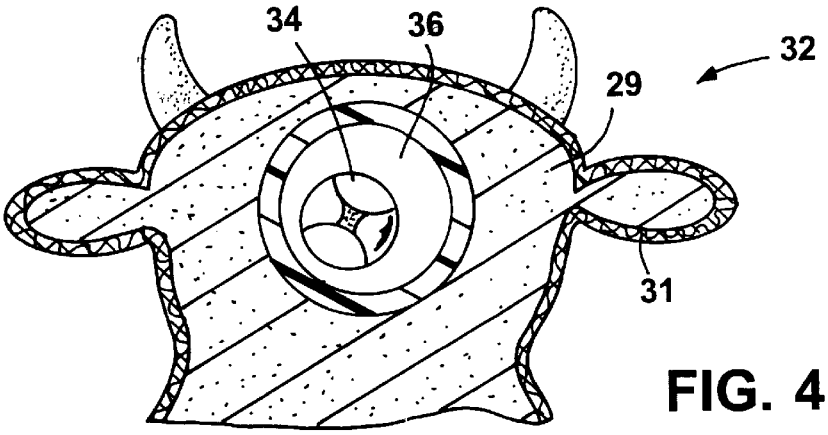
FIG. 4 is a partial cross-sectional view of the device of FIG. 1, taken along line 4—4 in FIG. 1.
Figure 2:
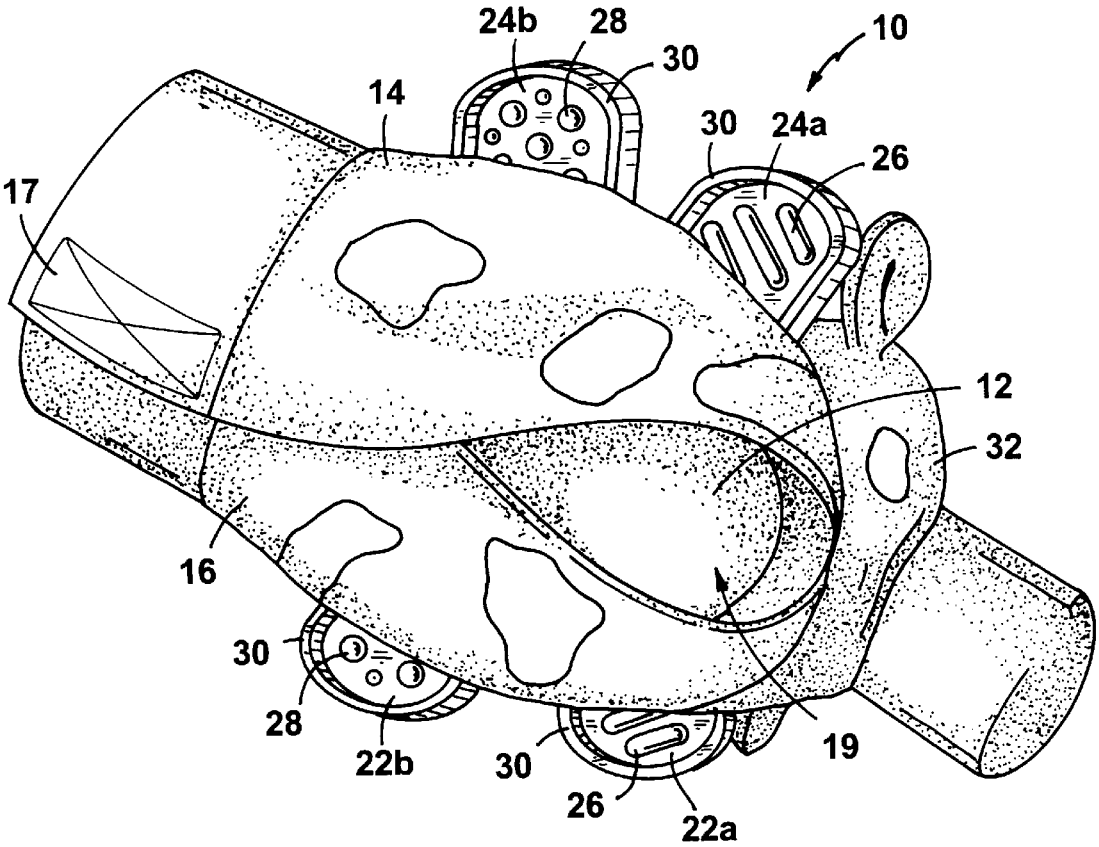
FIG. 2 is a perspective view of the teething device of FIG. 1, in a closed position (i.e., as the device would appear when fastened about an infant's hand), taken from below.
Figure 3:
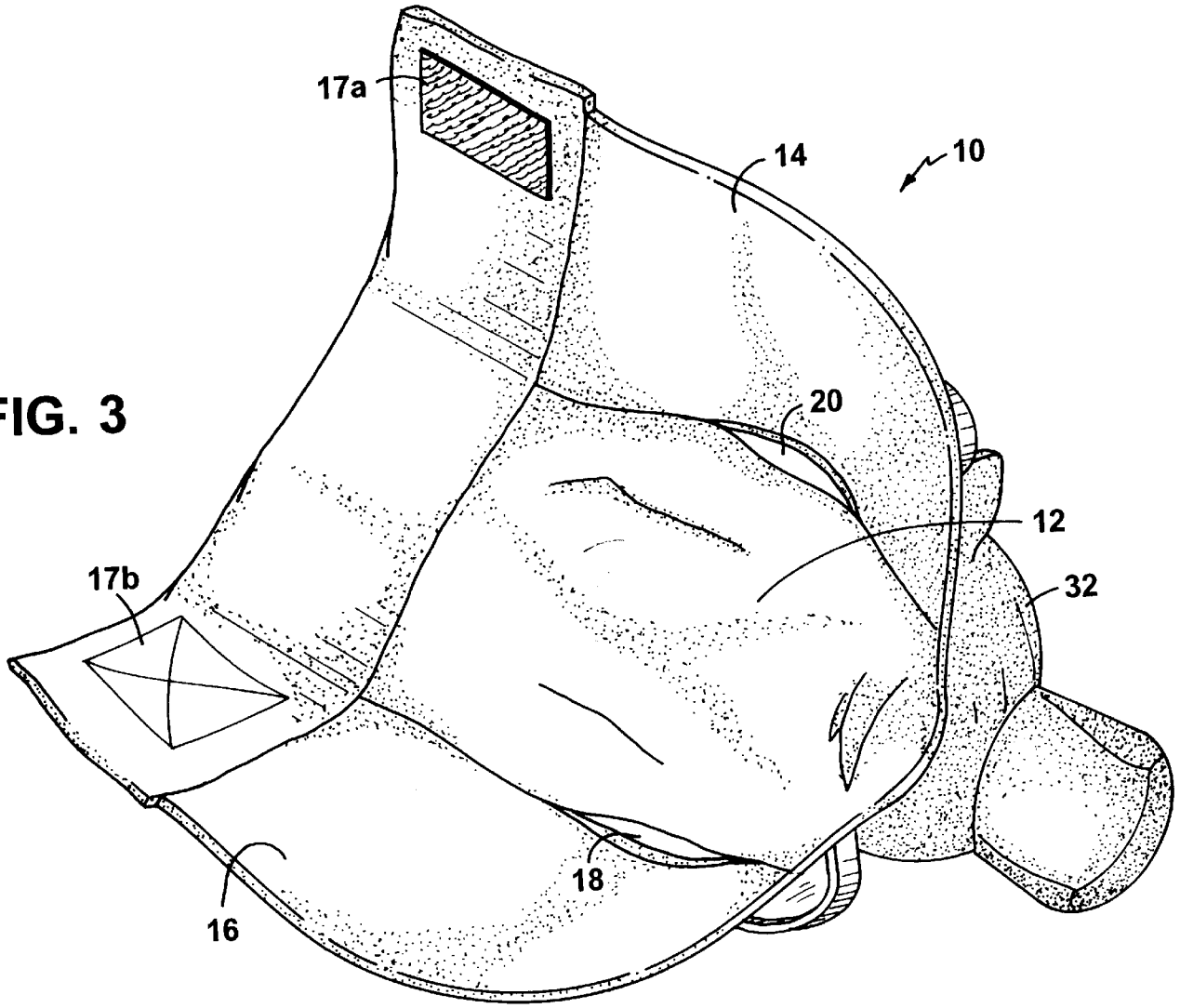
FIG. 3 is a perspective view of the teething device of FIG. 1, in an open position, taken from below.

Referring to FIGS. 1–3, a teething device 10 includes a first fabric portion 12, dimensioned to cover the back of the hand of an infant, and second and third fabric portions 14, 16 (FIGS. 2 and 3) that are dimensioned at one end to overlap around the wrist of the infant, and be fastened in the closed position shown in FIG. 2 by a fastener 17 having fastener portions 17*a*, 17*b* on the second and third fabric portions 14, 16, respectively (see FIG. 3). Preferably, fastener 17 is a hook and loop type fastener, e.g., of the type available under the tradename VELCRO. When the second and third portions 14, 16 are so fastened, an open area 19 is provided at the other end, opposite the one end, on the side of the teething device opposite the first fabric portion 12, as shown in FIG. 2, to allow relatively unrestricted movement of the infant's fingers, allowing the device to be comfortably worn by infants who dislike having their fingers confined.

Between the first fabric portion 12 and each of the second and third portions 14, 16, the device 10 includes an unenclosed aperture 18, 20 (see FIG. 3). These apertures are sized to receive and expose the thumb of the infant, so that the first fabric portion 12 extends over the back of the infant's hand and is secured in place by the infant's thumb and the fastening of the overlapping second and third portions. Two apertures are included, rather than a single aperture, so that the device can be worn on either hand.

Teething device 10 also includes two pairs of elastomeric teething tabs 22*a*, 22*b* and 24*a*, 24*b*, each pair being positioned so that one teething tab extends on each side of each of the apertures 18, 20. The teething tabs are formed of any resilient material suitable for use in teething devices, e.g., PVC, and are positioned to allow the infant to chew easily on the tabs while the device is being worn. Preferably, as shown, the teething tabs include ridges 26 and/or bumps 28 and rim 30, to stimulate chewing and massage the infant's gums during teething.

A toy 32 is mounted on the outer surface of first fabric portion 12, to amuse the infant and encourage the infant to chew on the teething tabs. The toy 32 is positioned so that it will rest upon the back of the infant's hand when the device is in use. In the illustrated embodiment, toy 32 is in the form of a cow's head. The cow's head is formed of a soft, resilient material 29, e.g., a foam or other conventional stuffing, covered by a fabric, e.g., polyester tricot, covering 31. A cavity 36 provided inside the cow's head contains a rattle 34.

Other embodiments are within the claims. For example, while the second and third fabric portions have been described above, and shown in the figures, as separate pieces of fabric dimensioned to be overlapped and fastened, the second and third portions could instead be a single, integral web. In this case, the fabric, e.g., LYCRA fabric or other stretch material, used for this integral web would be sufficiently elastic to allow the web to stretch and receive the infant's hand.

Moreover, although the toy is shown in the figures as a cow, the toy could be in the form of any animal or other figure, or could be any other type of toy that is capable of being mounted on first portion 12 and is suitable for use by an infant.

Further, while two pairs of teething tabs are shown, the device could include more or fewer tabs, and/or could include teething portions having a different shape.

Instead of a fabric, the first, second, and/or third portions could be formed from a non-woven or other suitable soft, flexible sheet material.

The device could include other features that are suitable for use by infants, e.g., a pacifier or separate rattle.

What is claimed is:

1. A device sized to fit an infant's hand and wrist, comprising:

(a) a first portion of sheet material that is dimensioned to cover the back of the infant's hand when the device is in use, (b) second and third portions of sheet material, extending outwardly from the first portion, said second and third portions are constructed to overlap and being dimensioned at one end of the device to extend around and fit a portion of the infant's wrist, (c) the first, second and third portions defining, when the device is in use, an opening on the side of the device opposite the first portion and at the end of the device opposite the one end, the opening dimensioned to receive and expose the infant's fingers and to allow relatively unrestricted movement of the infant's fingers, (d) an unenclosed aperture, separate from said opening, dimensioned to receive and expose one of an infant's thumbs, positioned in the vicinity of the intersection of said first portion and one of said second and third portions, and (e) a toy mounted on the first portion.

2. The device of claim 1 further comprising a fastener to secure the second and third portions in their overlapped position.

3. The device of either one of claim 1 wherein said first, second and third portions comprise a fabric.

4. The device of either one of claim 1 further comprising a teething portion mounted on said device in a position in which the teething portion can be sucked upon by an infant wearing the device.

5. The device of claim 4 wherein said teething portion comprises a plurality of elastomeric teething tabs.

6. The device of claim 5 wherein said teething tabs are mounted to extend outwardly from the device when the device is in use.

7. The device of either one of claim 1 wherein said device includes a rattle.

8. The device of either one of claim 1 wherein the toy, is constructed in the shape of an animal or an animal's head.

9. The device of claim 8 wherein the toy is formed of a soft, resilient material that is fabric-covered.

10. The device of claim 8 wherein said shape comprises an animal's head, further comprising a rattle contained in the head of the animal-shaped toy.

11. The device of claim 6 wherein said elastomeric teething tabs are mounted adjacent the aperture.

12. The device of either one of claim 1 further comprising a second unenclosed aperture, positioned so that the device can be used on either the infant's left or right hand.

* * * * *